United States Patent [19]

Rhodes

[11] 3,992,746

[45] Nov. 23, 1976

[54] APPARATUS FOR THE TREATMENT OF TEXTILE FABRICS

[76] Inventor: Eric Stanley Rhodes, 6, Valley Drive, Westwood Park, Leek, County of Stafford, England

[22] Filed: Feb. 24, 1975

[21] Appl. No.: 552,623

Related U.S. Application Data

[63] Continuation-in-part of Ser. No. 534,882, Dec. 20, 1974, abandoned, which is a continuation of Ser. No. 314,970, Dec. 14, 1972, abandoned.

[30] Foreign Application Priority Data

Dec. 16, 1971 United Kingdom ..... 58404/71

[52] U.S. Cl. ..... 15/307

[51] Int. Cl.[2] ..... A47L 5/38

[58] Field of Search ..... 15/303, 306 R, 306 A, 15/307

[56] References Cited

UNITED STATES PATENTS

| | | | |
|---|---|---|---|
| 1,629,154 | 5/1927 | Ybarrondo | 15/306 A |
| 2,689,196 | 9/1954 | Daniels | 15/306 A X |
| 2,784,652 | 3/1957 | Hornbostel | 15/306 A X |
| 3,119,140 | 1/1964 | Sallet | 15/306 A |

FOREIGN PATENTS OR APPLICATIONS

| | | | |
|---|---|---|---|
| 843,806 | 8/1960 | United Kingdom | 15/306 A |

*Primary Examiner*—Christopher K. Moore
*Attorney, Agent, or Firm*—Norris & Bateman

[57] ABSTRACT

Apparatus for extracting liquid or moisture from fabrics in continuous length in which air is drawn through a slot in a suction pipe arranged in proximity to the interior of a portion of the perforated body of a drum or through a slot formed by peripheral members of a frame arranged inside the drum, seals being formed around the slots to ensure that air drawn into the drum therethrough the perforations in the drum body and through the fabric carried over the slot in a tensionless state as the drum rotates.

3 Claims, 5 Drawing Figures

APPARATUS FOR THE TREATMENT OF TEXTILE FABRICS

This is a continuation-in-part of my copending application Ser. No. 534,882 filed Dec. 20, 1974, now abandoned, which in turn was a continuation of Ser. No. 314,970, filed 12-14-72 now abandoned.

This invention relates to improvements in apparatus for extracting liquid or moisture from fabrics.

In the continuous scouring, washing and other liquid treatment of fabrics, the fabric is passed continuously through the machine in a substantially tensionless condition with one length of fabric sewn or otherwise secured to a following length. Surplus liquid is squeezed from the fabric by squeeze rollers through the nip of the rollers but owing to the speed at which the fabric travels through the nip considerable moisture is still present in the fabric. The lengths of fabric are then separated into their individual lengths and spun or dried before passing to a stenter or other machine after again being sewn into a continuous length.

The object of the invention is to enable the fabric to be dried in a continuous length on emerging from the scouring or like machine for passing directly to a stenter or other machine.

According to the invention the apparatus comprises a perforated cylindrical rotary drum connected to a suction tube, a transverse slot below a portion of the drum communicating with a suction pipe by which air is drawn therethrough and through the fabric travelling thereover in a tensionless state to extract liquid or moisture therefrom and means for adjusting the width of the slot.

The invention will be described with reference to the accompanying drawings:

FIG. 1 is a vertical section through the drum;

FIG. 1*a* is a detail view of the slot;

Fabric from a scouring, washing or other liquid treatment machine passes in continuous length on emerging from the machine over a perforated drum A having a periphery of substantially channel section, the drum being rotated so that the periphery moves at a surface speed of the fabric delivered from the scouring or other fabric treating machine, the fabric thus passing over the drum in a substantially tensionless state.

The drum A is closed at one end by a disc *a*3 and is open at the opposite end which is formed by a circular ring *b*6, a perforated metal mesh sheet forming the cylindrical wall *b*7 of the drum the edges of which rest on the periphery of the disc *a*3 and the ring *b*6 and being secured thereto by rings *b*2. Flanges *b*1 for the drum engage the drum wall *b*7 and are affixed to the rings *b*2 at each end of the drum. The fabric passes over the outer surface of the rotating drum A between flanges *b*1.

The drum A is mounted on a shaft *a* to rotate in bearing *a*1 and is driven by a pulley *a*2. The end disc *a*3 may be provided with lightening holes *a*4.

A suction tube B having a slot *b* the length of the drum is mounted inside the drum with the slot *b* in proximity to the underside of the perforated wall *b*7 of the drum. A suction pump (not shown) is connected to the tube to draw air through the tube B and perforated wall *b*7 from the interior of the drum, the air passing through the fabric and extracting moisture therefrom which passes with the air into the tube B.

As the extraction of the moisture takes place from outside the drum through the channel in the drum the suction across the slot *b* is uniform over the whole length of the drum. As the drum may be of indefinite length the suction pump may be connected to a plurality of points to apply suction to the tube B thereby levelling out any possibility of variation in negative pressure along the length of the slot *b*.

The effective area of the slot *b* is varied by mounting arcuate plates *b*3 on brackets *b*8 affixed to the tube B, each plate *b*3 having an arcuate slot through which passes a bolt to vary the distance apart of the two plates, each plate *b*3 being secured to a radially extending plate *b*9.

The flanges *b*1 of the drum slope outwards to prevent the fabric running off and a bar *c*4 carries flexible flaps *c*1 which lie on the perforated wall to blank off the perforated wall outside the width of the fabric.

The surface of the perforated wall may be covered with a mesh fabric to isolate the fabric passing thereover from the perforations.

A seal C is provided between the sides and ends of the slot *b* in the stationary tube B and the underside of the perforations in the relatively rotating drum to ensure that the air entering the tube passes through the fabric and perforations.

Figure 1:
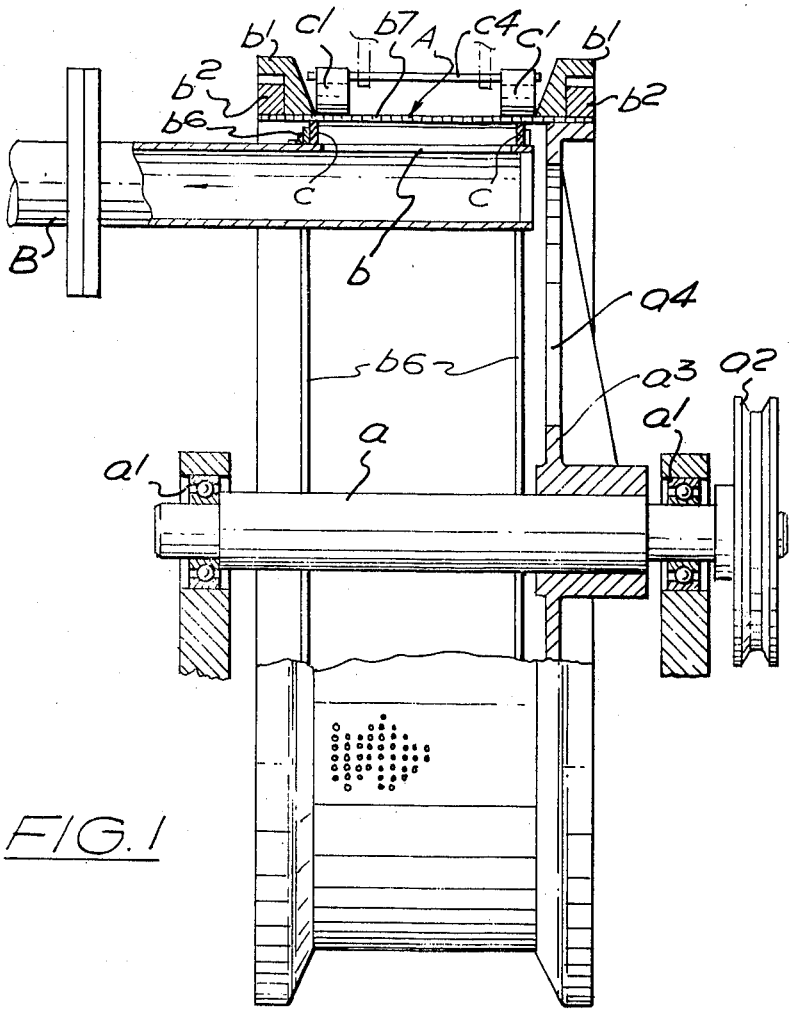
Figure 1A:
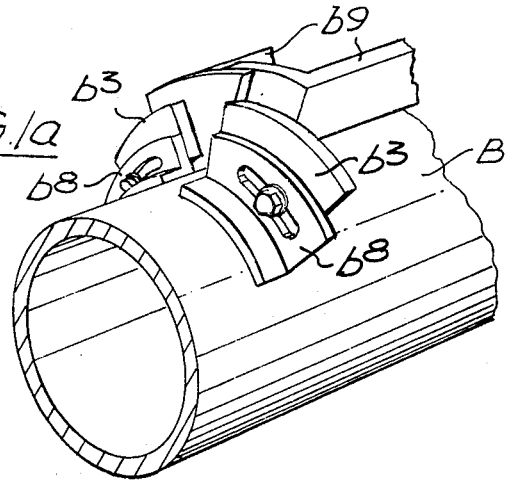
Figure 2:
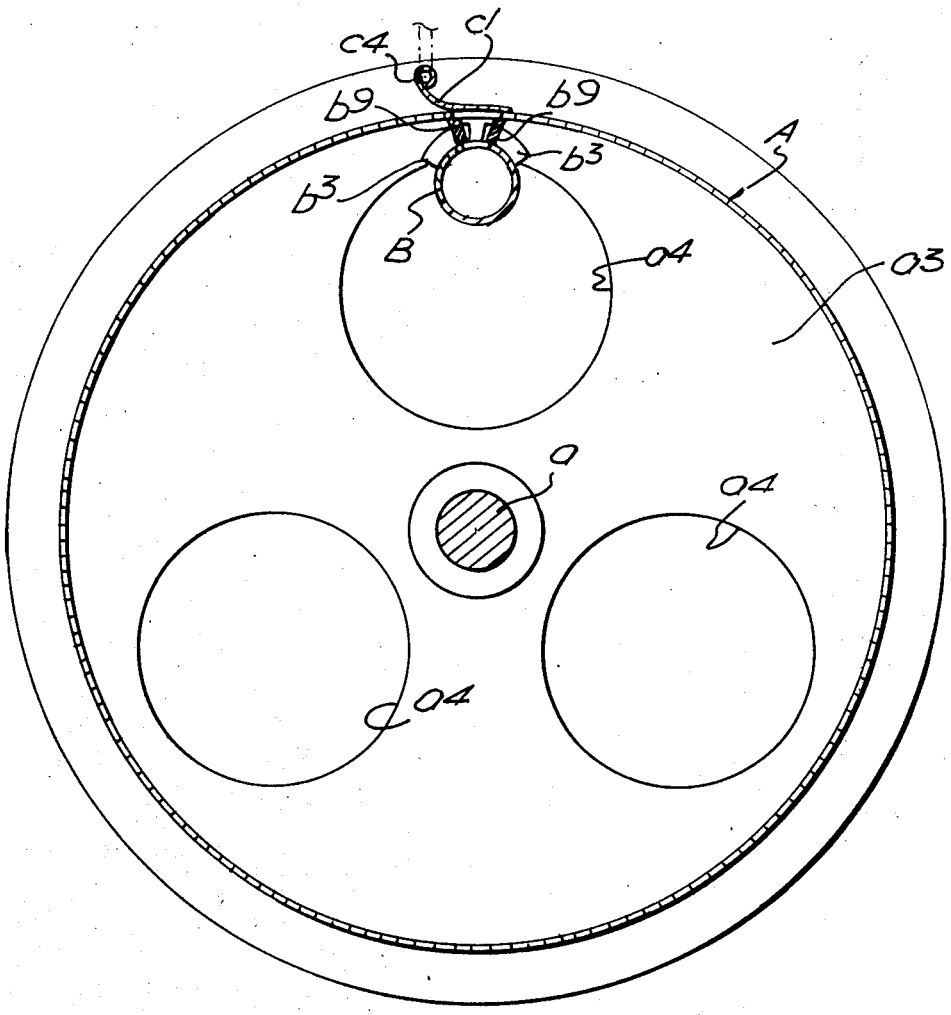
FIG. 2 is a vertical section at right angles to FIG. 1.

Since slot *b* as shown and described extends lengthwise of the drum, that long dimension of the slot is referred to as its length. The width of the slot is therefore its dimension between opposite lengitudinal edges, which is the distance for example between plates *b*9 in FIG. 1*a*. One adjustment for varying the width of the slot is illustrated in FIG. 1*a*.

The two plates *b*9 enclose a chamber which becomes a vacuum chamber and equalises the negative pressure throughout the whole chamber thereby applying an equal pressure over the whole width of the cloth due to the pressure drop within the chamber.

Figure 3:
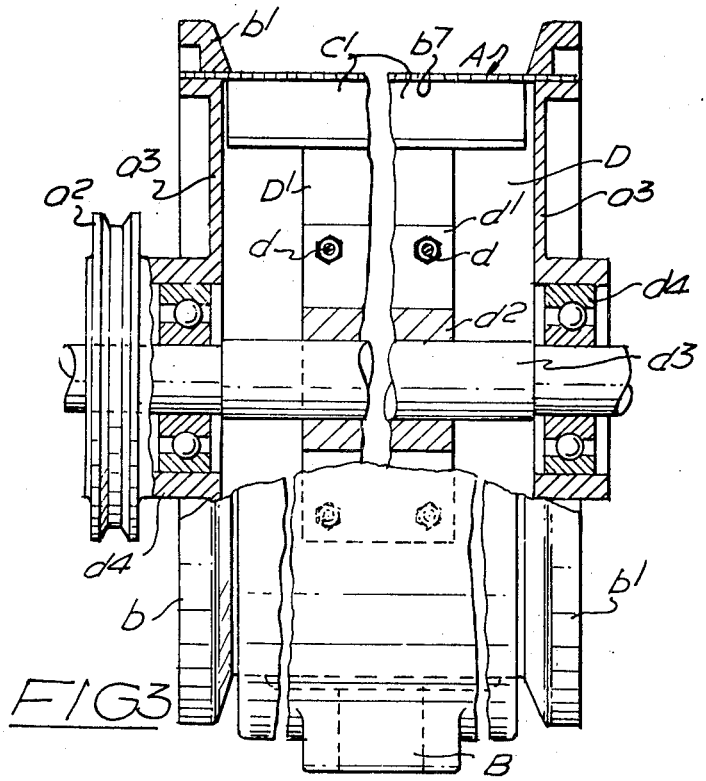
FIG. 3 is a vertical section of a further arrangement.
Figure 4:
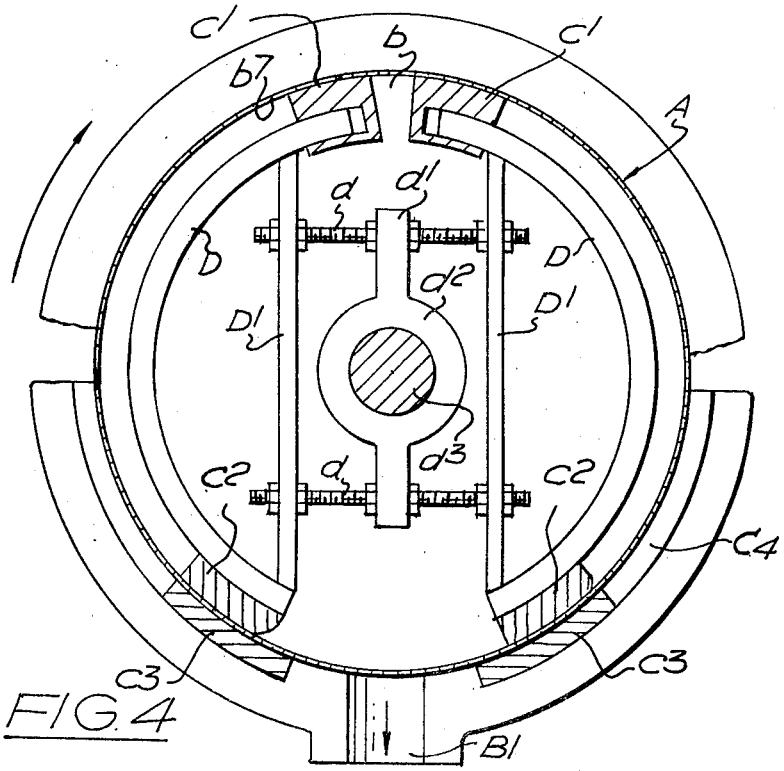
FIG. 4 is a vertical section at right angles to FIG. 3.

In the construction shown in FIGS. 3 and 4 the perforated drum is carried by a casing C4 surrounding the lower half of the drum and air is drawn into the interior of the drum A as this latter rotates around two segmental plates D which blank off portions of the drum, the air being exhausted through a tube or pipe B1 in the drum casing by the pump. The setting of the segmental plates D may be adjusted, to vary the area of the drum through which air can be drawn, by bolts *d* connecting discs D1 mounted on the plates D to vary their distance apart, the plates D being supported by the bolts which pass through portions *d*1 of a clamping member *d*2 mounted on a stationary shaft *d*3 about which the drum rotates in bearing *d*4 supporting end discs *a*3 one of which is driven by the pulley *a*2. A seal C1 is provided on each of the adjacent ends of plate D to define the sides of the slot *b* the seals engaging the underside of the wall *b*7 of the drum.

Further seals C2 are provided on the opposite ends of the plates D to engage the inner surface of the drum wall with seals C3 on the casing C4 engaging the outside of the drum to prevent leakage around the outlet pipe B1. The plates D are carried on the discs D1 connected to the portions *d*1 of the clamping member *d*2 by the bolts *d* to open or close the slot *b*.

In both arrangements the fabric is supported by the drum so that the fabric is not drawn into the suction pipes B, B1 thereby preventing damage to even light fabrics.

The invention is applicable to the extraction of moisture from fabrics in rope or open width.

The length of slot *b* is its long dimension lengthwise of the perforated drum, and the width of the slot *b* is its short dimension circumferentially of the periphery of drum A. FIG. 4 shows the adjustment of plates D whereby the distance between seals C1 may be varied to thereby vary the width of slot *b*.

Since suction is applied by the pump (not shown) to outlet pipe B1 the interior of the assembly between outlet B1 and slot *b* in FIG. 4 provides a uniform pressure vacuum chamber that applies a constant suction over the entire length and width of slot *b*.

What I claim is:

1. Apparatus for extracting moisture from a continuous length of fabric comprising a rotatable drum having a perforated cylindrical wall over which the fabric is drawn, a stationary shaft on which said drum is rotatably mounted, means for rotating the drum at substantially the linear speed of the moving fabric so that the fabric is in substantially tensionless state in passing over the drum, means defining a relatively stationary slot extending substantially throughout its length within and lengthwise of the drum adjacent the inner periphery of the drum, said slot defining means comprising two separate opposed plates mounted on said shaft and mounting a pair of opposed seal means having spaced facing edges defining said slot, said seal means being in sliding contact with the interior of said drum, means for relatively adjusting said plates to vary the spacing between said seal means and thereby vary the effective slot width, and means for applying suction to said slot for drawing air inwardly of the perforated cylindrical wall of the drum through the fabric.

2. The apparatus defined in claim 1, wherein said plates are arcuate segments adjacent the inner periphery of the drum.

3. The apparatus defined in claim 1, including a casing extending over the lower half of the drum with said means for applying suction comprising means defining an outlet through said casing, and said plates being arcuate to extend adjacent the periphery of said drum with opposed seal means being mounted on one pair of opposed edges of said plates, and additional seal means mounted on the other pair of edges of said plates coacting with the interior of the drum for directing exhaust of air through said outlet.

* * * * *